United States Patent [19]

Beane et al.

[11] 4,074,559

[45] Feb. 21, 1978

[54] FORGING METHOD

[75] Inventors: David J. Beane; Ronald M. Kaplan, both of North Palm Beach, Fla.

[73] Assignee: United Technologies Corporation, Hartford, Conn.

[21] Appl. No.: 744,069

[22] Filed: Nov. 22, 1976

Related U.S. Application Data

[62] Division of Ser. No. 635,181, Nov. 25, 1975, Pat. No. 4,051,708.

[51] Int. Cl.[2] ..... B21K 1/32

[52] U.S. Cl. ..... 72/354; 29/159 R; 29/156.8 B; 72/403

[58] Field of Search ..... 29/159 R, 156.8 B, 159.2, 29/159.3; 72/353, 354, 357, 358, 359, 360, 377, 475, 403

[56] References Cited

U.S. PATENT DOCUMENTS

| | | | |
|---|---|---|---|
| 3,122,823 | 3/1964 | Lazar | 29/156.8 B |
| 3,286,498 | 11/1966 | Cogan | 72/357 X |
| 3,370,450 | 2/1968 | Sheucher | 72/354 |
| 3,750,450 | 8/1973 | Sharp | 72/353 |

FOREIGN PATENT DOCUMENTS

| | | | |
|---|---|---|---|
| 838,611 | 6/1960 | United Kingdom | 72/354 |

*Primary Examiner*—Leon Gilden
*Attorney, Agent, or Firm*—Jack N. McCarthy

[57] ABSTRACT

A method of making a disc having integral blades wherein (1) a billet is preformed with the disc being formed close to final shape except that material needed to complete the outer portion including the blades is placed adjacent the outer edge of the preform; (2) the preform dies are changed and the preform is pressed into its final form. The outer die is formed as a two part die having an inner section and outer section, said outer section placing a holding force on the inner formed section and a forming force on the material needed to complete the disc and blades. The blade dies are formed to have a blade cavity longer than the length of the blade desired so that the ends of the blades can be machined to a desired length.

3 Claims, 3 Drawing Figures

FORGING METHOD

This is a division of application Ser. No. 635,181, filed Nov. 25, 1975, now U.S. Pat. No. 4,051,708.

BACKGROUND OF THE INVENTION

This invention relates to a method of forming a disc with integral blades. Attempts have been made to form discs with integral blades by using a single pressing. A method of making turbine wheel is disclosed in U.S. Pat. No. 3,122,823. Further, U.S. Pat. No. 3,791,821 discloses a method of processing an integral disc and blade component and U.S. Pat. No. 3,750,450 discloses an apparatus having a plurality of relatively moveable forming elements.

SUMMARY OF THE INVENTION

A primary object of the present invention is to provide a method of forming an integrally bladed disc to final shape.

Another object of the invention is to provide a method having two steps, (1) a billet is preformed to a shape which is near the final shape at the center but with extra material located at the rim, (2) the preformed shape is re-shaped by having the extra material pressed into a rim and blades.

A further object of the invention is to provide dies for forming a disc having integral blades. The dies including upper, lower, and rim dies.

Another object of the invention is to provide a segmented upper die having an inner section and an outer section, said outer section being changed between steps to achieve the proper forming.

A further object of the invention is to provide two separate rim die means for the first and second step.

DESCRIPTION OF THE PREFERRED EMBODIMENT

Figure 1:
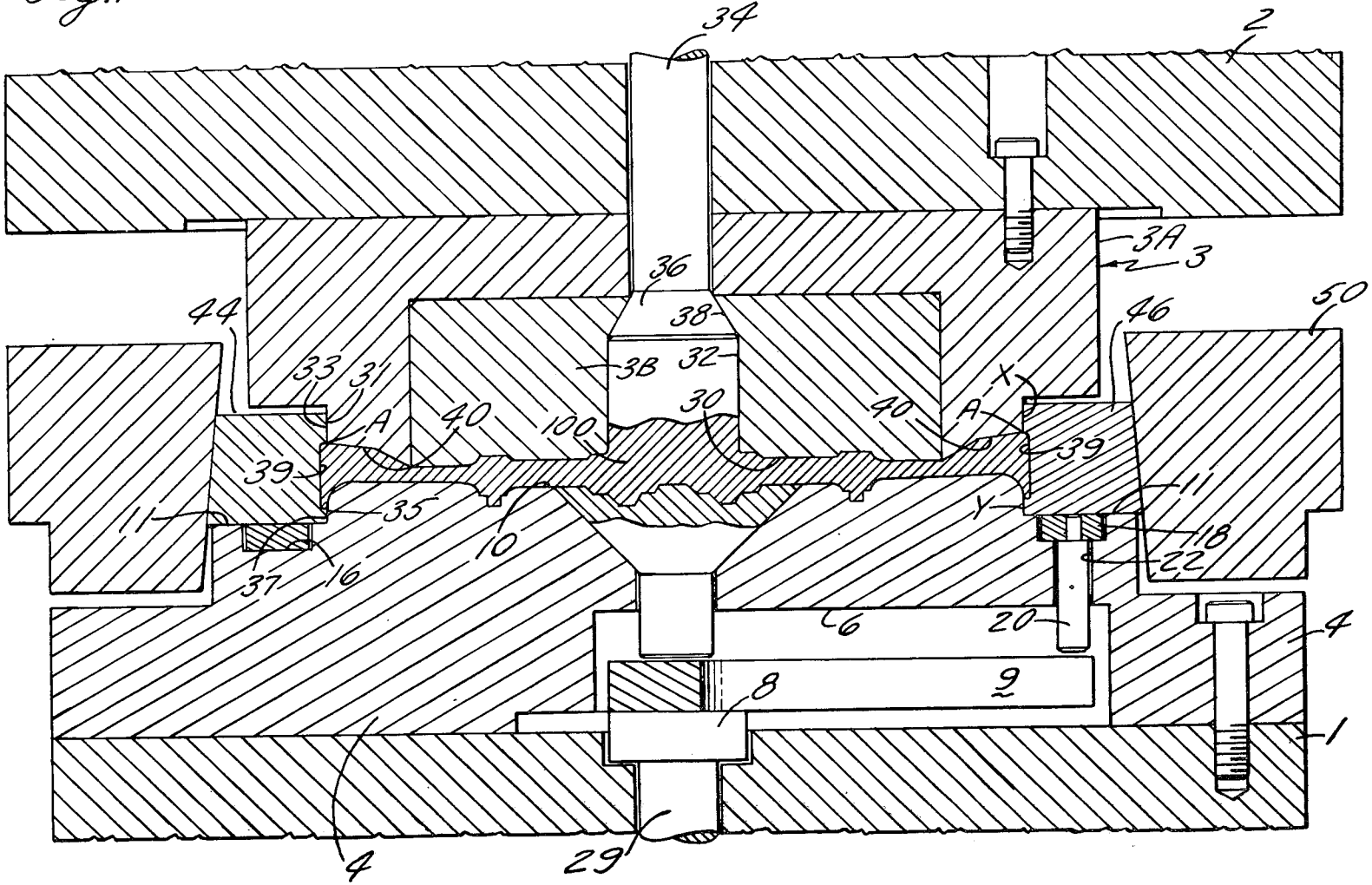
FIG. 1 is a view of a portion of a forging apparatus showing a billet pressed to a preformed shape.

In FIG. 1 the lower portion of the apparatus disclosed includes a bed 1 onto which a lower die 4 is fixed. The lower die 4 has an opening 6 in the bottom side thereof which has three equally spaced extending grooves to receive a knockout pin head 8 which has three arms 9 spaced 120° apart. The knockout head is fixed to the top of a knockout pin 29. This pin 29 extends through the bed and can be actuated by any means desired when necessary. The lower die 4 comprises an upper surface 10 contoured to the finished configuration of a disc. A flat annular surface 11 extends around the contoured face of the die and is formed below the outer circumference of the finished surface to receive rim die means 14A and 14B.

An annular recess 16 extends around the annular face 11 and contains a ring member 18. The ring member 18 has three pins 20 fixed thereto which extend downwardly therefrom at three points equally spaced about the ring member. These pins extend through openings 22 in the lower die 4 to be positioned adjacent the ends of the arms 9 of the knockout pin head 8, for a purpose to be hereinafter described.

The center of the lower die 4 has a conical recess 24 at the center thereof with a center portion 4A positioned therein, a short shaft portion 26 extends downwardly therefrom through an opening in the center of the lower die 4 to a point adjacent the center of the knockout pin head 8, for a purpose to be hereinafter described. As can be seen from FIG. 1 the contour of the upper surface 10 carries across over both parts of the lower die 4 and insert 4A.

The upper portion of the apparatus disclosed includes a ram 2 onto which an upper two-part die 3 is fixed. This upper die 3 includes an outer section 3A and inner section 3B. The outer section 3A is shown bolted to the ram 2 and while fixing means are not shown for inner section 3B, it can be bolted to outer section 3A or through 3A to the ram 2. In the step represented by FIG. 1 the outer section 3A and inner section 3B function as a single die member.

The inner section 3B of the upper die 3 comprises a lower surface 30 which is contoured to the finished configuration of a disc. The center portion is recessed at 32 to form a shaft section on the disc. The length of the shaft section is determined by the end of a knockout pin 34. This pin 34 extends through the ram 2 and can be actuated by any means desired when necessary. The head 36 of the knockout pin 34 is formed of a section of a cone and mates with a conical surface 38 at the top end of the inner section 3B. It can be seen that if a shorter shaft section of a disc is desired, a cylindrical portion can be added to the head 36.

The outer section 3A of the upper die 3 comprises a lower annular surface 40 which is contoured to an intermediate configuration which will permit the formation of an annular preformed shape at this point having an amount of metal which is required to fill the remaining desired configuration of the disc and blades during a final pressing. The outer forming edge A of the surface 40 is formed at a point which will also be found on the finished disc, as will be hereinafter described.

A rim die means 14A is positioned circumferentially around the cooperating ends of the lower die 4 and upper die 3A. As stated hereinbefore the rim die means 14A has its bottom surface on the annular surface 11 formed on the lower die 4. This rim die means 14A is formed of a plurality of sections. In the method shown, two half rings 44 and 46 were used.

The rim die means 14A has an upper inner cylindrical surface 31 which operatively mates with an upper outer cylindrical surface 33 on the outer section 3A of FIG. 1, and the rim die means 14A has a lower inner cylindrical surface 35 which operatively mates with a lower outer cylindrical surface 37 on the lower die 4 of FIG. 1. The inner surface of the rim die means 14A between these mating surfaces is contoured forming a cavity section 39 to provide a substantial part of the annular platform of the blades to be formed. This can be seen in FIG. 2 where the annular preformed shape is shown as compared with the final platform configuration. The top edge of cavity section 39 is located on the inner surface of the rim die means 14A so as to be positioned next to the edge A of the surface 40 when the upper die 3 has reached its final position as shown in FIG. 1. The rim die means is held in place by a back-up ring 50. This back-up ring has a mating tapered surface engagement with the outer peripheral wall of rim die means 14A to support it and maintain it in place. The tapered surface cams the rim die means inwardly. The back-up ring 50 can be raised and lowered or held in place as desired, by any means desired.

After the ram 2 has moved the upper die 3 into the position shown in FIG. 1 wherein a billet has been pressed to the preformed shape 100 as shown, the back-up ring 50 is raised for removing the force on the rim die means 14A, then the two-part upper die 3 is removed with the outer section 3A being replaced by a new outer section 3A'. The rim die means 14A is also removed by having the two half rings 44 and 46 withdrawn. The rim die means 14A is replaced by a rim die means 14B which comprises a plurality of blade dies 60.

The outer section 3A' of the upper die 3 comprises a lower annular surface 40A which is contoured to form the final configuration of the outer portion of the disc. The outer forming line A' of the surface 40A is located on outer section 3A' so that when the outer section 3A' reaches the final position shown in FIG. 3, the line A' is located at the same position with respect to the inner section 3B that edge A of the surface 40 is in FIG. 1. An upper outer cylindrical surface 70 is formed on outer section 3A' above the line A', similar to the upper outer cylindrical surface 33 on outer section 3A for a purpose to be hereinafter disclosed.

The blade dies 60 are positioned on the annular surface 11 forming an annular ring the same size as that formed by the half rings 44 and 46 in FIG. 1. Each blade die 60 is formed having a cavity section 62 extending the width thereof, between an upper surface 61 and lower surface 63, for forming a blade platform. Adjacent blade dies 60 have complimentary cavities in their adjacent surfaces cooperating to form a blade shaped cavity 64. (See FIGS. 6 and 7 of U.S. Pat. No. 3,122,823.) Other blade dies could be used such as blade dies with blade cavities entirely in the die if the blade tapered down from its platform to its tip. The adjacent upper surfaces 61 of adjacent blade dies 60 form an upper inner cylindrical surface and the adjacent lower surfaces 63 of adjacent blade dies 60 form a lower inner cylindrical surface. The outer surfaces of the blade dies 60 are tapered for mating with the back-up ring 50 similar to the taper formed on the half rings 44 and 46.

The rim die means 14A has its upper inner cylindrical surface, formed by adjacent upper surfaces 61, arranged to operatively mate with the upper outer cylindrical surface 70 on the outer section 3A', and its lower inner cylindrical surface, formed by adjacent lower surfaces 63, arranged to operatively mate with the lower outer cylindrical surface 37 on the lower die 4. The inner surface of the rim die means 14B, has an annular cavity made up of the plurality of cavities 62 of the blade dies 60 and this annular cavity provides the annular platform of the blades formed in blade cavities 64 between the blade dies 60.

Figure 3:
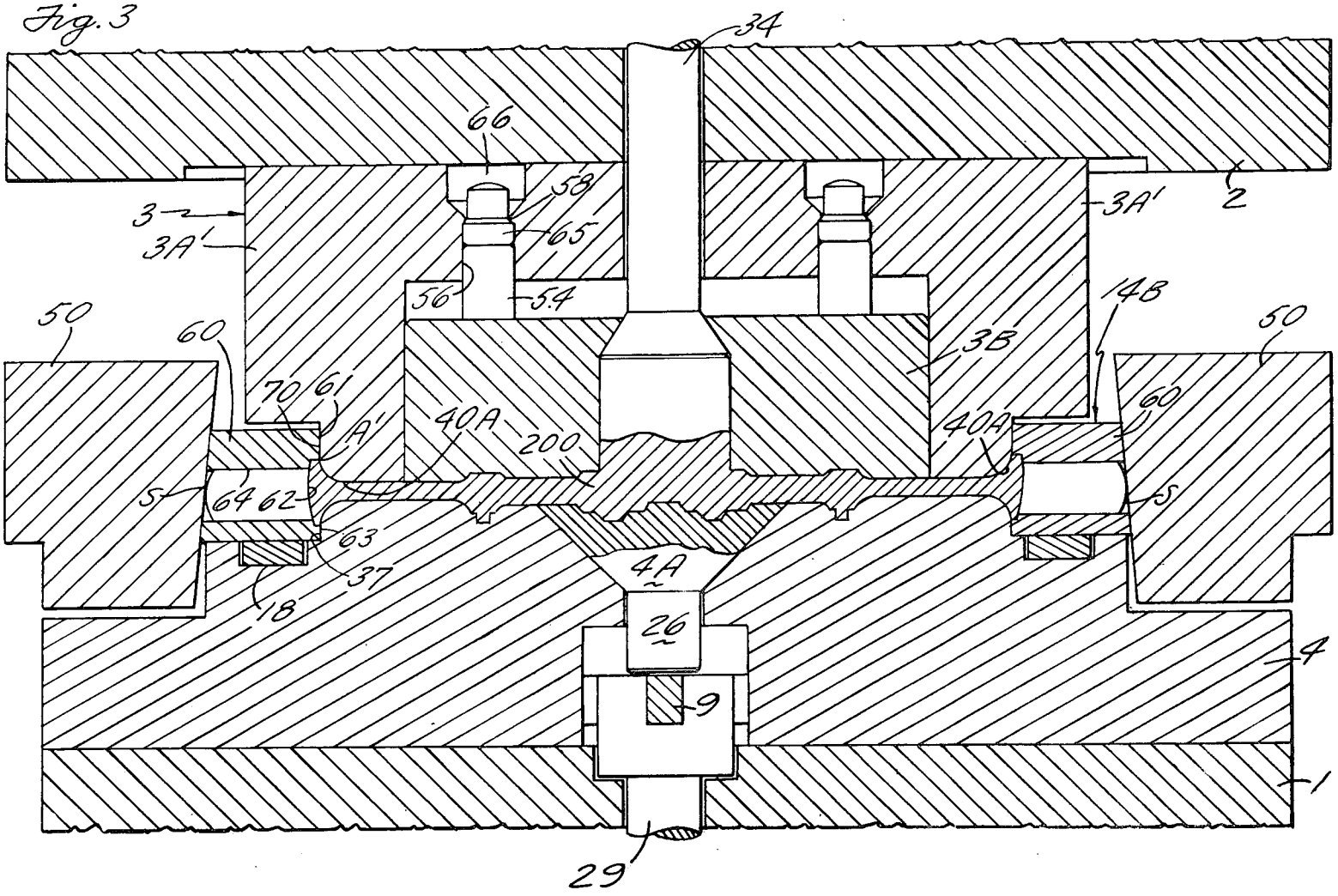
FIG. 3 is a view of a portion of a forging apparatus showing the preformed part pressed into the final shape of a disc and blades.

It can be seen that the intermediate configuration of the preformed shape 100 includes an annular preformed end shape having an extra amount of material and when the lowermost portion of the surface 40A contacts the preformed shape, there is space C located between the top of the inner section 3B of the upper die and the inner cooperating surface 52 of the outer section 3A'. In order to hold the lower surface 30 against the finished configuration of the disc while the outer portion is being formed by the new outer section 3A', deformable pins can be placed between the members 3A' and 3B having a length C. As the ram 2 lowers, moving the outer section 3A' to its end position where the outer portion of the disc and blades are finally formed as shown in FIG. 3, the pins are deformed by being flattened out. By selecting the size, number, material, and amount of deformation of the pins, the force transmitted from the ram through the outer section 3A' to the inner section 3B can be controlled, so that the desired amount of available force can be concentrated on the outer portion of the preformed shape 100. This load on the inner section 3B also resists reverse material flow.

Figure 2:
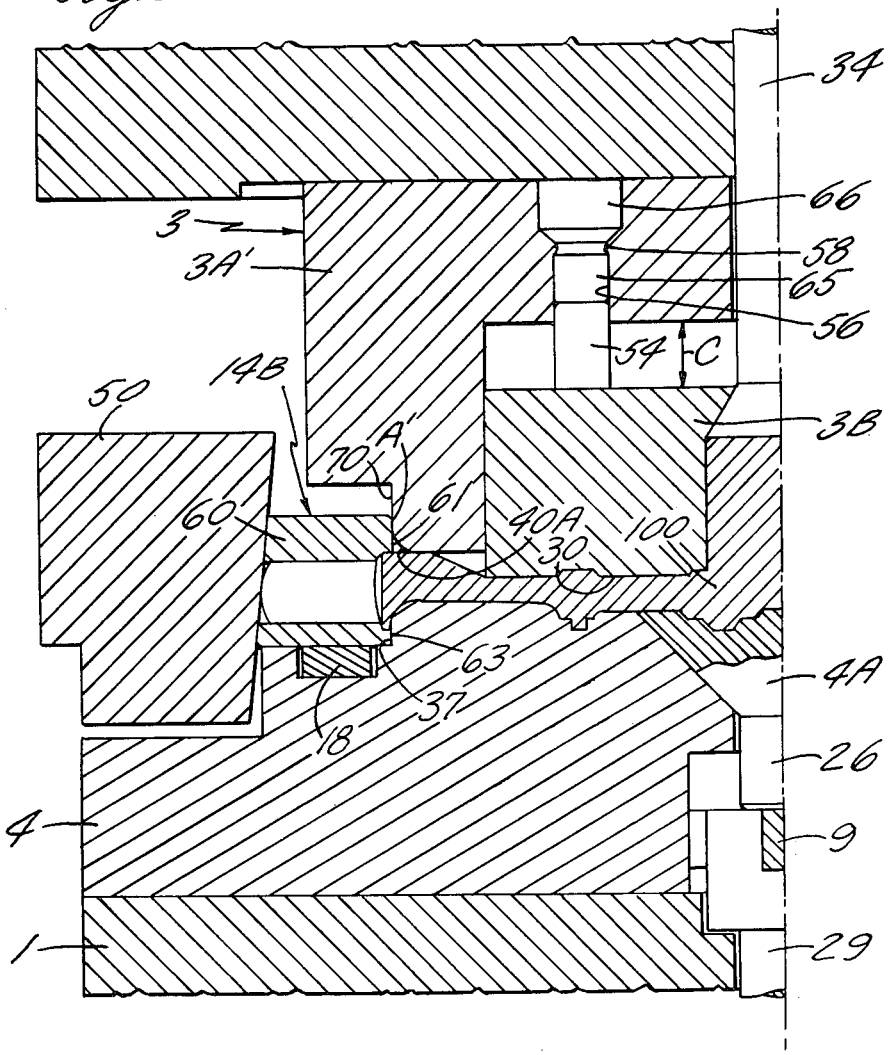
FIG. 2 is a view of a portion of a forging apparatus showing the preformed billet with another upper die portion and rim die means.

In FIGS. 2 and 3 a modification is shown of the pin method just described. This modification uses a plurality of symetrically spaced cylindrical openings 56 in outer section 3A' which extend upwardly from the surface 52 with a restriction 58 being placed at an inner location where the opening 56 opens into a larger chamber 66. This symetric pattern could be square with four pins being located 90° apart at an equal radius from the center of the pin 34. In this modification, rigid pins 54 having a length slightly greater than C are positioned with their lower end against the upper surface of inner section 3B while the upper end extends into the lower part of an opening 56. A deformable pin 65 is placed between the upper end of the pin 54 and the restriction 58, in each of the locations where a circular opening 56 is placed. Now, as the ram 2 lowers, the pins 65 are not flattened out but are extruded through the restriction 58 into the chamber 66. The force transmitted can be controlled here just as it was with the deformable pins merely placed between the members 3A' and 3B. See FIG. 3 where the pins 54 have pushed a part of the deformable pins 65 through the restriction 58.

As the ram 2 moves from the position in FIG. 2 to that in FIG. 3 the force is divided between the inner section 3B and the outer section 3A' of the upper die 3, as set forth above, and the material of the annular preformed shape formed by the surface 40 at the outer edge thereof, is pressed into the cavities 62 and 64. The material pressed into each of the cavities 64 assumes a curved shape S at its forward outer end due to friction between the material being pressed and the sides of the die. In a specific blade design the length of each of the blade cavities 64 is made longer than the blade length desired so that the blade can be machined to its proper length after the billet has been pressed to the configuration shown in FIG. 3.

After the ram 2 has moved the upper die 3 into the position shown in FIG. 3 wherein a preformed shape 100 has been pressed to the final shape 200 of a disc and blades, the upper die 3 is removed and the back-up ring 50 is removed. Means are then used to move the blade dies 60 radially outwardly so that they will not get locked onto the blades as a result of the difference in thermal coefficient of expansion between the material of the blades and the material of the dies. A specific die removal means is shown in copending application Ser. No. 635,188 filed herewith for an Apparatus and Method for Removing a Plurality of Blade Dies to George Kelch.

We claim:

1. In combination, an apparatus for forming a disc with integral blades from a preformed forging having one finished side surface and one side surface with a finished inner surface and an enlarged unfinished outer surface including a press, lower die means, upper die means, rim die means, said lower die means comprising a die portion for supporting one finished side surface, said upper die means having a center inner die portion for engaging said finished inner surface and a separate outer die portion therearound for engaging said enlarged unfinished outer surface, said center inner die portion having á finished forging surface to mate with the finished inner surface of the preformed forging, said outer die portion having a finished forging surface to engage the enlarged unfinished outer surface, said rim die means having radially extending blade cavities, means for holding said center inner die portion against the finished inner surface of the preformed forging while pressing the outer die portion downwardly against the enlarged unfinished outer surface to provide a finished outer surface and press the material into the blade cavities, said center inner die portion having an upwardly facing surface, said outer die portion having a part extending radially inwardly over said upwardly facing surface, said part extending radially inwardly being spaced from said upwardly facing surface, deformable means being placed between said part extending radially inwardly and said upwardly facing surface to limit the forces transmitted between said outer die portion as it moves downwardly and said center inner die portion by deformation of the deformable means.

2. A combination as set forth in claim 1 wherein a cylindrical opening means extends upwardly in said outer die portion from said downwardly facing surface, restriction means being placed in said cylindrical opening means, rigid pin means being placed between said upwardly facing surface and extending into said cylindrical opening means, deformable pin means being located in said cylindrical opening means between said rigid pin means and said restriction means.

3. A combination as set forth in claim 1 wherein said deformable means is a pin means.

* * * * *